US012209470B2

(12) United States Patent
Arsalan et al.

(10) Patent No.: US 12,209,470 B2
(45) Date of Patent: Jan. 28, 2025

(54) WOVEN SLEEVES AND RELATED METHODS OF CONSTRAINING A WELL TOOL

(71) Applicants: Saudi Arabian Oil Company, Dhahran (SA); WIRELESS INSTRUMENTATION SYSTEMS AS, Trondheim (NO)

(72) Inventors: Muhammad Arsalan, Dhahran (SA); Henrik Wanvik Clayborough, Trondheim (NO); Jarl André Fellinghaug, Leinstrand (NO); Stian Marius Hansen, Trondheim (NO)

(73) Assignees: WIRELESS INSTRUMENTATION SYSTEMS AS, Trondheim (SA); Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/989,232

(22) Filed: Nov. 17, 2022

(65) Prior Publication Data

US 2024/0167352 A1 May 23, 2024

(51) Int. Cl.
*E21B 23/04* (2006.01)
*D03D 3/02* (2006.01)
(Continued)

(52) U.S. Cl.
CPC ..... *E21B 23/04* (2013.01); *D03D 3/02* (2013.01); *D03D 13/008* (2013.01);
(Continued)

(58) Field of Classification Search
CPC ..... E21B 23/04; D03D 3/02; D03D 13/008; D03D 15/573
See application file for complete search history.

(56) References Cited

U.S. PATENT DOCUMENTS 2,643,723 A 6/1953 Lynes
3,175,618 A 3/1965 Lang et al.
(Continued)

FOREIGN PATENT DOCUMENTS

CN 201496028 6/2010
CN 114542006 5/2022
(Continued)

OTHER PUBLICATIONS

Barree et al., "Realistic Assessment of Proppant Pack Conductivity for Material Section," SPE-84306-MS, presented at the Annual Technical Conference, Oct. 5-8, 2003, Society of Petroleum Engineers, 12 pages.

(Continued)

*Primary Examiner* — D. Andrews
*Assistant Examiner* — Ronald R Runyan
(74) *Attorney, Agent, or Firm* — Fish & Richardson P.C.

(57) ABSTRACT

A woven sleeve includes a tubular member that includes circumferentially oriented fibers and axially oriented fibers. The tubular member is configured to adjust between a relaxed state in which the tubular member is positioned around a well tool and an extended state in which the tubular member is in tight contact with an outer surface of the well tool across substantially an entire inner surface of the tubular member to limit an extent to which the well tool can expand radially outward.

18 Claims, 4 Drawing Sheets

(51) Int. Cl.
*D03D 13/00* (2006.01)
*D03D 15/283* (2021.01)
*D03D 15/573* (2021.01)

(52) U.S. Cl.
CPC ..... *D03D 15/283* (2021.01); *D03D 15/573* (2021.01); *D10B 2331/021* (2013.01); *D10B 2331/04* (2013.01); *D10B 2505/00* (2013.01)

(56) References Cited

U.S. PATENT DOCUMENTS

| | | | | |
|---|---|---|---|---|
| 3,916,999 | A | 11/1975 | Ellis et al. | |
| 3,918,520 | A | 11/1975 | Hutchison | |
| 5,375,622 | A | 12/1994 | Houston | |
| 5,613,555 | A | 3/1997 | Sorem et al. | |
| 5,975,205 | A | 11/1999 | Carisella | |
| 6,044,906 | A | 4/2000 | Saltel | |
| 6,578,638 | B2 | 6/2003 | Guillory et al. | |
| 6,595,283 | B1 | 7/2003 | Turley et al. | |
| 6,779,601 | B2 | 8/2004 | Wilson | |
| 9,217,308 | B2 | 12/2015 | Wood et al. | |
| 9,567,823 | B2 | 2/2017 | Turley | |
| 9,784,077 | B2 | 10/2017 | Gorrara | |
| 10,115,942 | B2 | 10/2018 | Qiao et al. | |
| 10,760,373 | B2 | 9/2020 | Phan et al. | |
| 10,934,814 | B2 | 3/2021 | Arsalan et al. | |
| 11,242,731 | B2 | 2/2022 | Arsalan et al. | |
| 2002/0092654 | A1 | 7/2002 | Coronado et al. | |
| 2004/0144535 | A1 | 7/2004 | Kalman et al. | |
| 2005/0226387 | A1* | 10/2005 | Tiearney | H01J 35/10 378/142 |
| 2007/0012437 | A1 | 1/2007 | Clingman et al. | |
| 2009/0126436 | A1 | 5/2009 | Fly et al. | |
| 2009/0308604 | A1* | 12/2009 | Corre | E21B 49/08 166/250.17 |
| 2012/0018143 | A1 | 1/2012 | Lembcke | |
| 2012/0155813 | A1 | 6/2012 | Quigley et al. | |
| 2013/0068481 | A1 | 3/2013 | Zhou | |
| 2016/0177659 | A1 | 6/2016 | Voll et al. | |
| 2019/0049054 | A1 | 2/2019 | Gunnarsson | |
| 2019/0376371 | A1 | 12/2019 | Arsalan | |
| 2020/0182024 | A1 | 6/2020 | Arsalan et al. | |

FOREIGN PATENT DOCUMENTS

| | | |
|---|---|---|
| JP | 2010156172 | 7/2010 |
| WO | WO 2017146593 | 8/2017 |

OTHER PUBLICATIONS

Gillard et al., "A New Approach to Generating Fracture Conductivity," SPE-135034-MS, presented at the SPE Annual Technical Conference and Exhibition, Sep. 19-22, 2010, Society of Petroleum Engineers 14 pages.

Gomaa et al., "Computational Fluid Dynamics Applied To Investigate Development and Optimization of Highly Conductive Channels within the Fracture Geometry," SPE-179143-MS, Society of Petroleum Engineers, SPE Production & Operations, 32, Nov. 14, 2017, 12 pages.

Gomaa et al., "Improving Fracture Conductivity by Developing and Optimizing a Channels Within the Fracture Geometry: CFD Study," SPE-178982-MS, Society of Petroleum Engineers, SPE International Conference and Exhibition on Formation Damage Control, Feb. 24-26, 2016, 25 pages.

Kern et al., "Propping Fractures With Aluminum Particles," SPE-1573-G-PA, Journal of Per. Technology, 1961, 13(6):583-589, 7 pages.

Meyer et al., "Theoretical Foundation and Design Formulae for Channel and Pillar Type Propped Fractures—A Method to Increase Fracture Conductivity," SPE-170781-MS, Society Of Petroleum Engineers, SPE Annual Technical Conference and Exhibition, Oct. 27-29, 2014, 25 pages.

Palisch et al., "Determining Realistic Fracture Conductivity and Understanding its Impact on Well Performance—Theory and Field Examples," SPE-106301-MS, Society of Petroleum Engineers, SPE Hydraulic Fracturing Technology Conference, Jan. 29-31, 2007, 13 pages.

Poollen et al., "Hydraulic Fracturing—Fracture Flow Capacity vs Well Productivity," SPE-890-G, presented at 32nd Annual Fall Meeting of Society of Petroleum Engineers, Oct. 6-9, 1957, published as Petroleum Transactions AIME vol. 213, 1958, 5 pages.

Poollen, "Productivity vs Permeability Damage in Hydraulically Produced Fractures," Paper 906-2-G, American Petroleum Institute, presented at Drilling and Production Practice, Jan. 1, 1957, 8 pages.

Tinsley et al., "A new method for providing increased fracture conductivity and improving stimulation results," SPE-4676-PA, Journal of Petroleum Technology, Nov. 1975, 27(11), 7 pages.

Vincent, "Examining Our Assumptions—Have Oversimplifications Jeopardized our Ability To Design Optimal Fracture Treatments," SPE-119143-MS, presented at the SPE Hydraulic Fracturing Technology Conference, Jan. 19-21, 2009, 51 pages.

Vincent, "Five Things You Didn't Want to Know about Hydraulic Fractures," ISRM-ICHF-2013-045, presented at the International Conference for Effective and Sustainable Hydraulic Fracturing: An ISRM specialized Conference, May 20-22, 2013, 14 pages.

Walker et al., "Proppants, We Still Don't Need No Proppants—A Perspective of Several Operators," SPE-38611-MS, presented at the SPE Annual Technical Conference and Exhibition, Sep. 27-30, 1995, 8 pages.

International Search Report and Written Opinion in International Appln. No. PCT/US2023/036784, mailed on Feb. 9, 2024, 14 pages.

* cited by examiner

WOVEN SLEEVES AND RELATED METHODS OF CONSTRAINING A WELL TOOL

TECHNICAL FIELD

This disclosure relates to woven sleeves, such as fabric or other woven sleeves constructed to limit an outer diameter of an interiorly disposed well tool.

BACKGROUND

Downhole well tools can be designed to expand radially outward within a wellbore to carry out their operational functions. In some examples, a downhole well tool may experience undesirable over-expansion in a radial direction due to the action of an inflatable packer or another expandable device. In some examples, the downhole well tool may experience undesirable uneven expansion in a radial direction along a length of the downhole tool. Both undesirable effects can negatively affect the accuracy and reliability of a performance of the well tool.

SUMMARY

This disclosure relates to woven sleeves, such as fabric woven sleeves constructed to limit an outer diameter of an interiorly disposed well tool that is capable of expanding radially outward within the woven sleeve.

In one aspect, a woven sleeve includes a tubular member that includes circumferentially oriented fibers and axially oriented fibers. The tubular member is configured to adjust between a relaxed state in which the tubular member is positioned around a well tool and an extended state in which the tubular member is in tight contact with an outer surface of the well tool across substantially an entire inner surface of the tubular member to limit an extent to which the well tool can expand radially outward.

Embodiments may provide one or more of the following features.

In some embodiments, the woven sleeve includes a fabric material.

In some embodiments, a first combined weight of the circumferentially oriented fibers is greater than a second combined weight of the axially oriented fibers.

In some embodiments, the circumferentially oriented fibers and the axially oriented fibers are made of one or both of natural fibers and synthetic fibers.

In some embodiments, the tubular member includes a unitary tube.

In some embodiments, the tubular member includes multiple tubes.

In some embodiments, the multiple tubes are spaced apart axially.

In some embodiments, two or more of the multiple tubes overlap at least partially.

In some embodiments, the woven sleeve has a specific weight of about 200 g/m$^2$ to about 800 g/m$^2$.

In some embodiments, the woven sleeve is configured to impose a substantially constant diameter on the well tool along a length of the well tool.

In some embodiments, the woven sleeve further comprises one or more fixation bands positioned along a length of the tubular member.

In some embodiments, the tubular member has a folded configuration.

In another aspect, a downhole system includes a well tool and a tubular woven sleeve surrounding the well tool. The tubular woven sleeve includes circumferentially oriented fibers and axially oriented fibers. The tubular woven sleeve is configured to adjust between a relaxed state in which the tubular woven sleeve is positioned around the well tool and an extended state in which the tubular woven sleeve is in tight contact with an outer surface of the well tool across substantially an entire inner surface of the tubular woven sleeve to limit an extent to which the well tool can expand radially outward.

In another aspect, a method of constraining a well tool includes placing a tubular woven sleeve around the well tool, expanding the well tool radially outward towards an inner surface of the tubular woven sleeve, creating contact between the well tool and the tubular woven sleeve across substantially an entire area of the inner surface of the tubular woven sleeve, and limiting an extent to which the well tool can expand radially outward to a maximally extended internal diameter of the tubular woven sleeve.

Embodiments may provide one or more of the following features.

In some embodiments, the method further includes imposing a substantially constant diameter on the well tool along a length of the well tool.

In some embodiments, the method further includes folding the tubular woven sleeve upon itself against the well tool.

In some embodiments, the method further includes reinforcing the contact between the well tool and the tubular woven sleeve.

In some embodiments, the tubular woven sleeve includes a fabric material.

In some embodiments, the tubular woven sleeve is made of one or both of natural fibers and synthetic fibers.

In some embodiments, the woven sleeve has a specific weight of about 200 g/m$^2$ to about 800 g/m$^2$.

The details of one or more embodiments are set forth in the accompanying drawings and description. Other features, aspects, and advantages of the embodiments will become apparent from the description, drawings, and claims.

DETAILED DESCRIPTION

Figure 1:
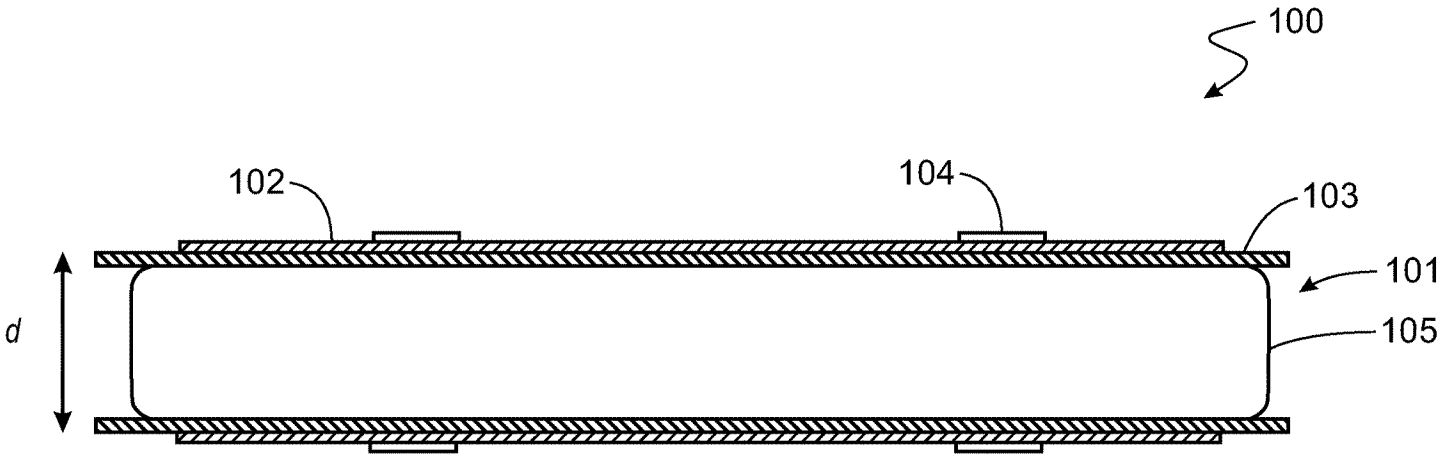
FIG. 1 is a cross-sectional view of a woven sleeve installed to a well tool in a relaxed state of the woven sleeve.
Figure 2:
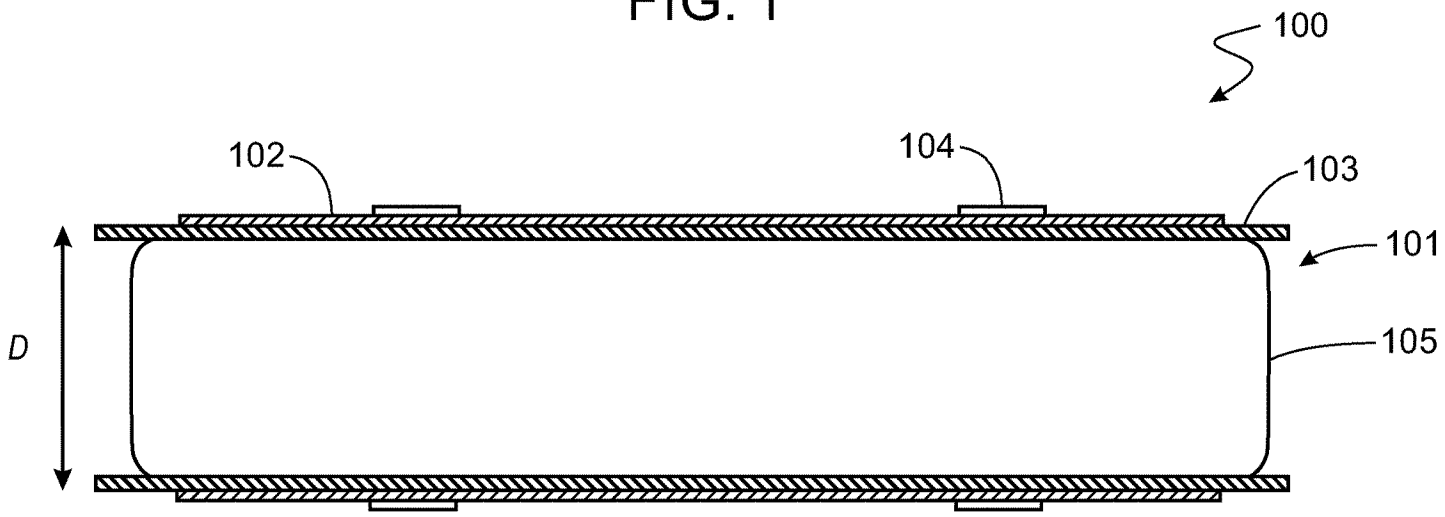
FIG. 2 is a cross-sectional view of the woven sleeve of FIG. 1, installed to the well tool in an extended state of the woven sleeve.

FIGS. 1 and 2 illustrate cross-sectional views of an example woven sleeve 100 that surrounds a well tool 101. In some embodiments, the woven sleeve 100 is a fabric sleeve. The well tool 101 includes a metal tubular section 103 (e.g., a steel tube) and an internal expandable device 105. In some embodiments, the metal tubular section 103 may be a single section or may be made of multiple separate tubular sections. In some embodiments, the expandable device 105 is an inflatable packer, a volume of fluid that otherwise provides a variable (e.g., increasable) internal fluid pressure, an expanding mandrel, a swaging cone, expanding slips, or another type of expandable device. The expandable device 105 is capable of expanding radially outward to accordingly expand the metal tubular section 101 radially outward from a first state of a first diameter d (shown in FIG. 1) to a second state of a second diameter D (shown in FIG. 2).

In some embodiments, the woven sleeve 100 is formed substantially as a tube 102 and is advantageously designed to limit an extent to which the well tool 101 can radially expand. In some embodiments, the tube 102 of the woven sleeve 100 may be constructed as a single piece of material. In other embodiments, the tube 102 of the woven sleeve 100 may be constructed of two or more separate pieces of material that are arranged axially. The multiple pieces may be spaced axially apart or may be arranged in a configuration in which they partially or fully overlap. In some embodiments, the multiple pieces may vary by one or more characteristics from one another, such as being made of different materials, having different material weights, and having different weave patterns.

Referring to FIG. 1, the woven sleeve 100 is sized to surround (e.g., snuggly surround) the well tool 101 (e.g., with substantially no slack or play) when the well tool 101 is in the first state, such that the woven sleeve 100 is in an initial, relaxed state. In some embodiments, the tubular section 103 may expand from the first state via plastic deformation. Referring to FIG. 2, the woven sleeve 100 is strong enough to withstand (e.g., to maintain its mechanical integrity under) an interior, radially outward directed pressure to constrain the well tool 101 to the second diameter D in the second state of the well tool 101. In some embodiments, the radially outward directed pressure may depend on one or more of a material, a weaving configuration, and a thickness of the woven sleeve 100. The state of the woven sleeve 100 illustrated in FIG. 2 corresponds to a final, extended (e.g., maximally stretched) state of the woven sleeve 100 for which the tubular section 103 is in tight contact with substantially the entire inner surface of the woven sleeve 100. Accordingly, the internal diameter of the woven sleeve 100 substantially defines (e.g., controls) the second diameter D when the woven sleeve 100 is in the extended state. In the extended state, the woven sleeve 100 is fixed in place against the tubular section 103 of the well tool 101 owing to the tight contact.

By constraining the diameter of the well tool 101, the woven sleeve 100 advantageously imposes an overall, substantially constant (e.g., consistent) outer diameter among multiple portions of the tubular section 103 that may otherwise expand to different diameters as a result of uneven expansion along the expansion device 105. In some examples, limiting the extent to which the well tool 101 can expand radially also limits a rate at which the well tool 101 can expand radially. For example, in some embodiments, as the contact force between the woven sleeve 100 and the well tool 101 increases, the rate at which the well tool 101 expands radially decreases. In some examples, the well tool 101 may be expanded to a diameter between the first diameter d and the second diameter D that corresponds to intermediate states of both the well tool 101 and the woven sleeve 100. Limiting the extent to which the well tool 101 can radially expand and doing so in a manner that achieves a substantially constant diameter of the well tool 101 in the expanded state can improve the performance of the well tool 101 with respect to both accuracy and reliability.

In some embodiments, the woven sleeve 100 is manufactured via a weaving process or a spinning process. In some embodiments, the woven sleeve 100 is made of one or more fabric materials. In some embodiments, the woven sleeve 100 (e.g., the tube 102) is made of one or both of natural and synthetic fibers that are made of one or more materials, such as aramid fibers, polyester, cotton, polyamide, glass, carbon, steel, and metal. In some embodiments, the woven sleeve 100 may be constructed in a way that maximizes its radial strength (e.g., hoop stress limit). For example, in some embodiments, circumferentially oriented fibers of the woven sleeve 100 account for a larger portion of a material weight of the woven sleeve 100 than do the axially oriented fibers of the woven sleeve 100. In some embodiments, the circumferentially oriented fibers and the axially oriented fibers may be made of different materials to achieve an optimal sleeve design. In some embodiments, the woven sleeve 100 may also be made of one or more hardening or curing compounds, such as epoxy, silicone, or another similar substance.

In some embodiments, the internal diameter of the woven sleeve 100 can increase from an initial width or diameter in the relaxed state to a final diameter in the maximally extended state by up to about 3% of the initial width or diameter. In some embodiments, the woven sleeve 100 can achieve a maximum extended internal diameter of about 9 centimeters (cm) to about 11 cm. In some embodiments, the woven sleeve 100 has a thickness of about 0.1 millimeters (mm) to about 3 mm. In some embodiments, the woven sleeve 100 has a length of about 10 cm to about 200 cm. In some embodiments, the woven sleeve 100 has a specific weight of about 200 grams per meter squared ($g/m^2$) to about 800 $g/m^2$. In some embodiments, the woven sleeve 100 has a fiber tenacity of about 1,000 meter·Newton per tex (mN/tex) to about 3,500 mN/tex, where 1 tex equals 1 gram per 1,000 m of textile material. In some embodiments, an example woven sleeve 100 has a width of about 155 mm, a warp of about 5 threads/cm, a deci-tex (dtex, where 1 dtex equals 1 gram per 10,000 m of textile material) of about 1.1 with polyester, a weft of about 12.5 threads/cm, a dtex of about 1.6 with aramid polymer, a specific weight of about 400 $g/m^2$, and a plain weave.

Figure 3:
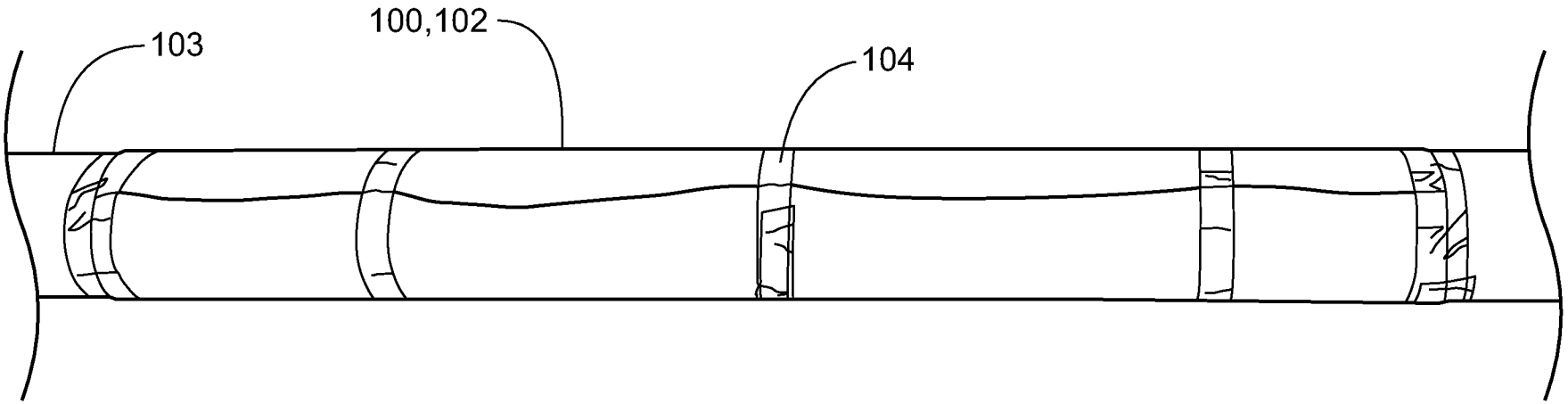
FIG. 3 is a perspective view of the woven sleeve of FIGS. 1 and 2, as folded upon itself against the well tool.

In some embodiments, in installing the woven sleeve 100 to the tubular section 103, the tube 102 is initially placed around the tubular section 103 in a loose configuration (e.g., with a gap or some slack between at least a portion of the inner surface of the tube 102 and at least a portion of the outer surface of the tubular section 103). In some embodiments, excess material of the tube 102 may then be folded upon itself against the tube 102 to position the tube 102 against the tubular section 103 with additional contact. Referring to FIG. 3, the tube 102 is then snuggly secured to the tubular section 103 with two or more fixation features, such as fixation bands 104 or straps. In some embodiments, the fixation bands 104 are made of an adhesive tape (e.g., a polyester film tape), a metal, or another material. In some embodiments, the fixation bands 104 are located at one or more ends of the tube 102. In some embodiments, the fixation bands 104 are located at one or more intermediate positions along the length of the tube 102. The fixation bands 104 are designed to prevent fraying of the tube 102 and to securely fix the tube 102 in place on the tubular section 103.

Figure 4:
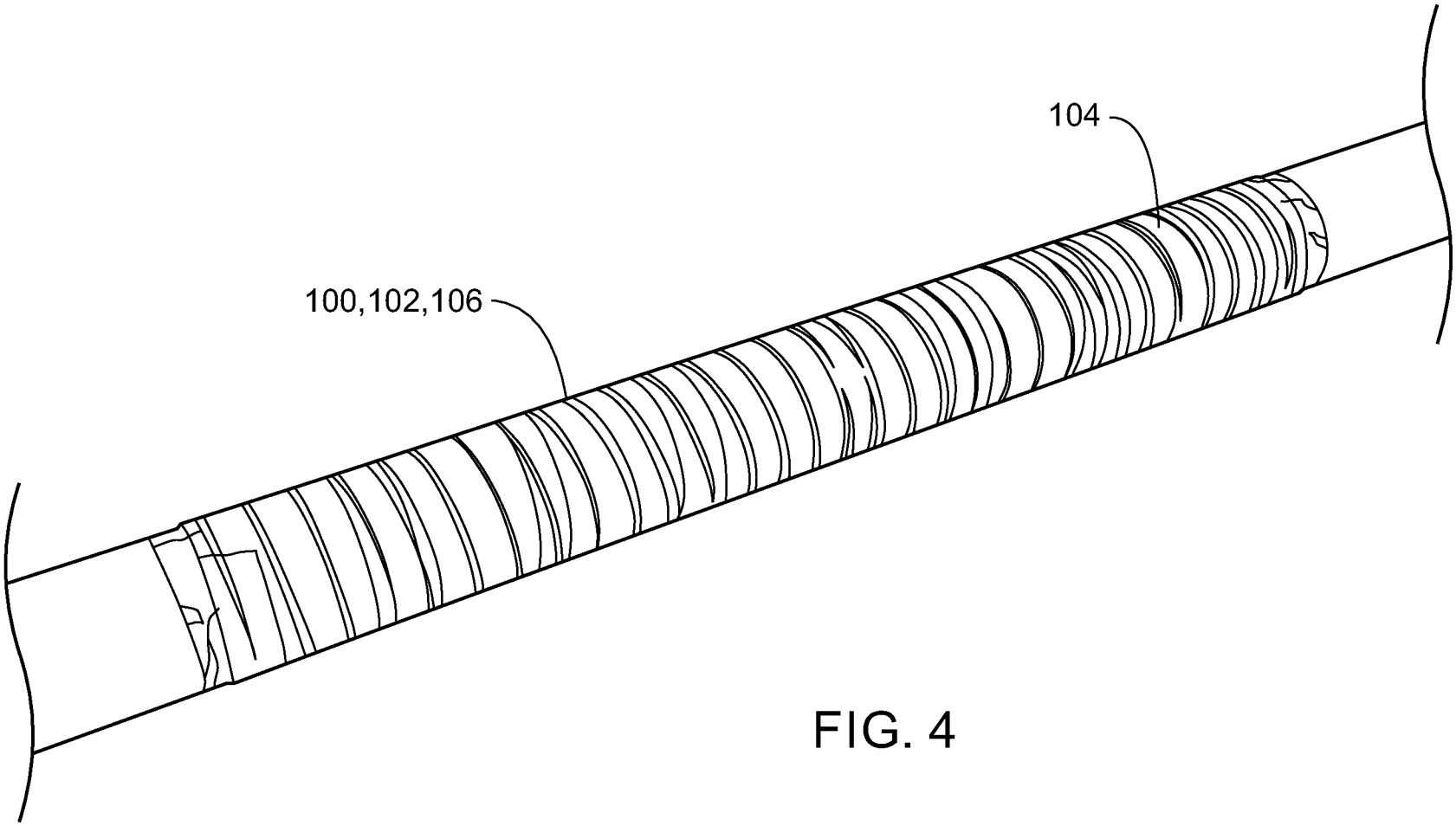
FIG. 4 is a perspective view of the woven sleeve of FIG. 3 with a surrounding adhesive layer.

Referring to FIG. 4, in some embodiments, the tube 102 and the fixation bands 104 may be further secured to the tubular section 103 with one or more outer bands 106 or film layers that are wrapped snuggly around or otherwise placed around the tube 102. In this way, installation of the tube 102 to the tubular section 104 is reinforced. The outer bands 106 and the fixation bands 104 may be made of the same material or made of different materials.

Figure 5:
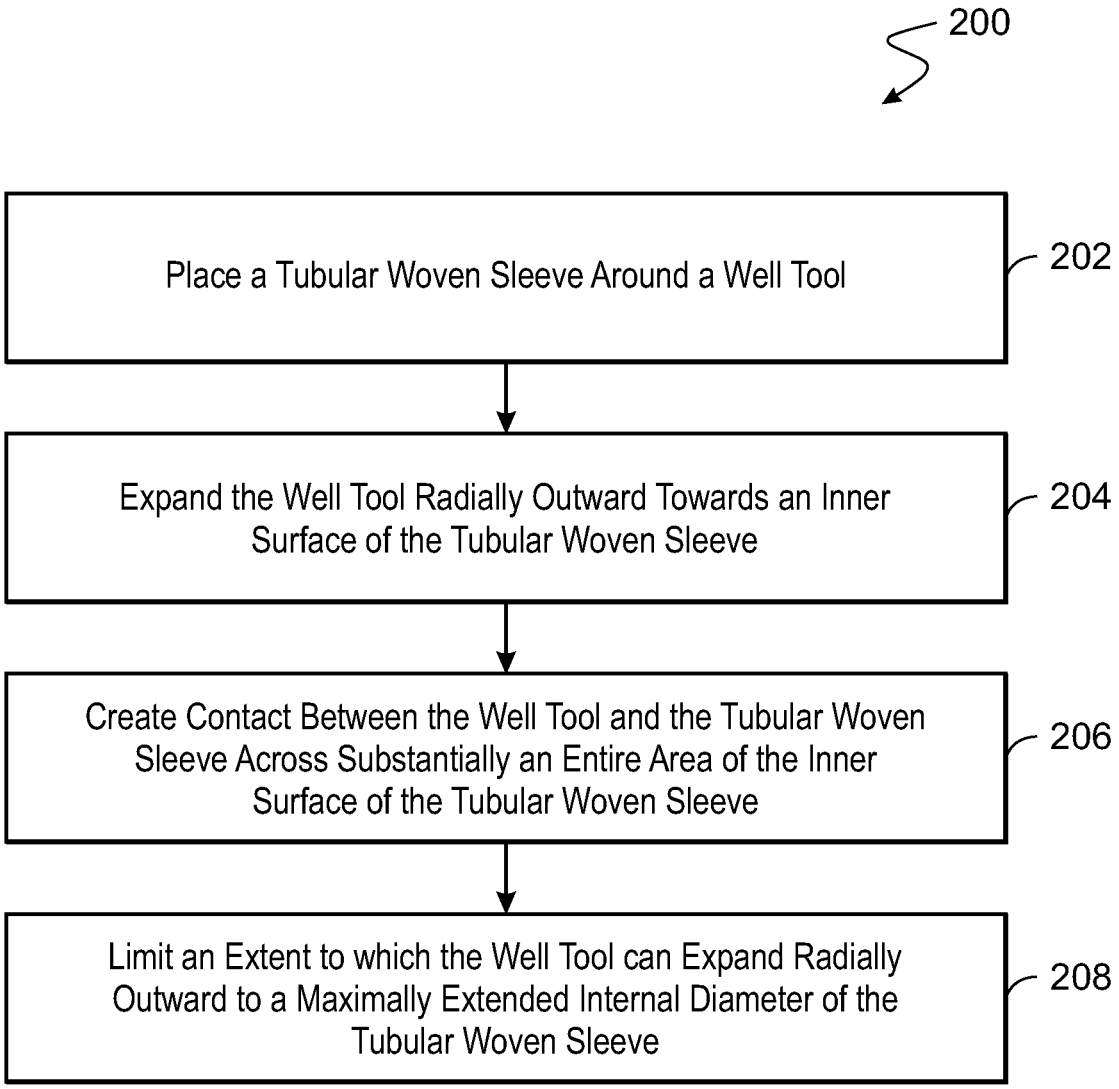
FIG. 5 is a flow chart illustrating an example method of constraining the well tool of FIGS. 1-4 using the woven sleeve of FIGS. 1-4.

FIG. 5 is a flow chart illustrating an example method 200 of constraining a well tool (e.g., the well tool 101). In some embodiments, the method 200 includes a step 202 for placing a tubular woven sleeve (e.g., the woven sleeve 100) around a well tool. In some embodiments, the method 200 includes a step 204 for expanding the well tool radially outward towards an inner surface of the tubular woven sleeve. In some embodiments, the method 200 includes a step 206 for creating contact between the well tool and the tubular woven sleeve across substantially an entire area of the inner surface of the tubular woven sleeve. In some embodiments, the method 200 includes a step 208 for limiting an extent to which the well tool can expand radially outward to a maximally extended internal diameter of the tubular woven sleeve.

While the woven sleeve 100 has been described and illustrated with respect to certain dimensions, sizes, shapes, arrangements, materials, well tools 101, and methods 200, in some embodiments, a woven sleeve that is otherwise substantially similar in construction and function to the woven sleeve 100 may include one or more different dimensions, sizes, shapes, arrangements, configurations, and materials or may be utilized with different well tools or according to different methods. For example, in some embodiments, a woven sleeve 100 that is otherwise substantially similar in construction and function to the woven sleeve 100 may generally be made of any spun material (e.g., steel wires or another spun material construction).

Accordingly, other embodiments are also within the scope of the following claims.

What is claimed is:

1. A woven sleeve comprising a tubular member including circumferentially oriented fibers and axially oriented fibers, the tubular member being configured to adjust between:

a relaxed state in which the tubular member is positioned around a well tool; and an extended state in which the tubular member is in tight contact with an outer surface of the well tool across substantially an entire inner surface of the tubular member to limit an extent to which the well tool can expand radially outward, wherein a first combined weight of the circumferentially oriented fibers is greater than a second combined weight of the axially oriented fibers.

2. The woven sleeve of claim 1, wherein the woven sleeve comprises a fabric material.

3. The woven sleeve of claim 1, wherein the circumferentially oriented fibers and the axially oriented fibers are made of one or both of natural fibers and synthetic fibers.

4. The woven sleeve of claim 1, wherein the tubular member comprises a unitary tube.

5. The woven sleeve of claim 1, wherein the tubular member comprises a plurality of tubes.

6. The woven sleeve of claim 5, wherein the plurality of tubes are spaced apart axially.

7. The woven sleeve of claim 5, wherein two or more of the plurality of tubes overlap at least partially.

8. The woven sleeve of claim 5, wherein the woven sleeve has a specific weight of about 200 $g/m^2$ to about 800 $g/m^2$.

9. The woven sleeve of claim 1, further comprising one or more fixation bands positioned along a length of the tubular member.

10. The woven sleeve of claim 1, wherein the tubular member has a folded configuration.

11. The woven sleeve of claim 1, wherein the woven sleeve is configured to impose a substantially constant diameter on the well tool along a length of the well tool.

12. A downhole system comprising:

a well tool; and a tubular woven sleeve surrounding the well tool, the tubular woven sleeve comprising circumferentially oriented fibers and axially oriented fibers, the tubular woven sleeve having a specific weight of about 200 $g/m^2$ to about 800 $g/m^2$, and being configured to adjust between:

a relaxed state in which the tubular woven sleeve surrounds the well tool, and an extended state in which the tubular woven sleeve is in tight contact with an outer surface of the well tool across substantially an entire inner surface of the tubular woven sleeve to limit an extent to which the well tool can expand radially outward.

13. A method of constraining a well tool, the method comprising:

placing a tubular woven sleeve around the well tool;

folding the tubular woven sleeve upon itself and against the well tool;

expanding the well tool radially outward towards an inner surface of the tubular woven sleeve;

creating contact between the well tool and the tubular woven sleeve across substantially an entire area of the inner surface of the tubular woven sleeve; and limiting an extent to which the well tool can expand radially outward to a maximally extended internal diameter of the tubular woven sleeve.

14. The method of claim 13, further comprising reinforcing the contact between the well tool and the tubular woven sleeve.

15. The method of claim 13, wherein the tubular woven sleeve comprises a fabric material.

16. The method of claim 13, wherein the tubular woven sleeve is made of one or both of natural fibers and synthetic fibers.

17. The method of claim 13, wherein the woven sleeve has a specific weight of about 200 $g/m^2$ to about 800 $g/m^2$.

18. The method of claim 13, further comprising imposing a substantially constant diameter on the well tool along a length of the well tool.

* * * * *